US009342041B2

(12) United States Patent
Noda et al.

(10) Patent No.: US 9,342,041 B2
(45) Date of Patent: May 17, 2016

(54) DEVELOPING CARTRIDGE HAVING DRIVE-FORCE RECEIVING MEMBER

(71) Applicant: Brother Kogyo Kabushiki Kaisha, Nagoya-shi, Aichi-ken (JP)

(72) Inventors: Ryuji Noda, Seto (JP); Takashi Shimizu, Nagoya (JP); Keita Shimizu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/590,407

(22) Filed: Jan. 6, 2015

(65) Prior Publication Data

US 2015/0192891 A1 Jul. 9, 2015

(30) Foreign Application Priority Data

Jan. 6, 2014 (JP) ..... 2014-000598
Jan. 6, 2014 (JP) ..... 2014-000599

(51) Int. Cl.
*G03G 15/04* (2006.01)
*G03G 21/16* (2006.01)
*G03G 15/08* (2006.01)

(52) U.S. Cl.
CPC ..... *G03G 21/1647* (2013.01); *G03G 15/0806* (2013.01); *G03G 21/1676* (2013.01); *G03G 15/0865* (2013.01); *G03G 2221/1657* (2013.01)

(58) Field of Classification Search
CPC ..... G03G 21/1647; G03G 21/1857
USPC ..... 399/119, 263
See application file for complete search history.

(56) References Cited

U.S. PATENT DOCUMENTS 5,678,139 A 10/1997 Nomura et al.
5,825,472 A 10/1998 Araki et al.
6,049,685 A 4/2000 Murakami et al.
6,898,399 B2 * 5/2005 Morioka ..... G03G 21/1825 399/167
8,417,131 B2 4/2013 Mori (Continued)

FOREIGN PATENT DOCUMENTS

JP 2009-294584 A 12/2009
JP 2011-039561 A 2/2011
JP 2011-133756 A 7/2011

OTHER PUBLICATIONS

Jun. 19, 2015—(US) Non-Final Office Action—U.S. Appl. No. 14/546,005.

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

In a developing cartridge, a drive-force receiving member includes: a first cylindrical part having a gear part transmitting drive force to a developing roller; a second cylindrical part disposed radially inward of the first cylindrical part and in contact with a support part; and a receiving part receiving drive force from outside of the developing cartridge. The receiving part is disposed outward of the first and second cylindrical parts in an axial direction in which a rotational axis extends. The receiving part has an internal space in communication with a gap between the first and second cylindrical parts. The receiving part is disposed to overlap the gap between the first and second cylindrical parts when the receiving part is viewed in the axial direction. The receiving part has an outward end in the axial direction, at least part of the outward end of the receiving part being closed.

13 Claims, 10 Drawing Sheets

(56) References Cited

U.S. PATENT DOCUMENTS

| | | | | |
|---|---|---|---|---|
| 2007/0003321 | A1 | 1/2007 | Hara et al. | |
| 2009/0208261 | A1 | 8/2009 | Kobayashi et al. | |
| 2010/0080581 | A1* | 4/2010 | Shimizu | 399/36 |
| 2010/0142995 | A1* | 6/2010 | Shiraki et al. | 399/111 |
| 2011/0081163 | A1* | 4/2011 | Lee | 399/110 |
| 2011/0158688 | A1 | 6/2011 | Mori | |
| 2013/0051848 | A1* | 2/2013 | Itabashi et al. | 399/111 |
| 2013/0170845 | A1* | 7/2013 | Itabashi | 399/12 |
| 2014/0105638 | A1* | 4/2014 | Shiraki et al. | 399/111 |
| 2015/0003868 | A1* | 1/2015 | Shimizu et al. | 399/119 |
| 2015/0139701 | A1 | 5/2015 | Noda et al. | |
| 2015/0277355 | A1* | 10/2015 | Taguchi | G03G 21/1896 399/12 |
| 2015/0280364 | A1* | 10/2015 | Masuda | H01R 13/6315 399/107 |

* cited by examiner

41

RIGHT ⟷ LEFT

DEVELOPING CARTRIDGE HAVING DRIVE-FORCE RECEIVING MEMBER

CROSS REFERENCE TO RELATED APPLICATION

This application claims priority from Japanese Patent Applications No. 2014-000598 filed Jan. 6, 2014 and No. 2014-000599 filed Jan. 6, 2014. The entire contents of these priority applications are incorporated herein by reference.

TECHNICAL FIELD

The present invention relates to a developing cartridge mountable in an image forming apparatus of an electrophotographic type.

BACKGROUND

One example of a developing cartridge mountable in an electrophotographic image forming apparatus has a developing roller for carrying toner. This developing cartridge is first mounted in a drum cartridge possessing a photosensitive drum, before being mounted in the image forming apparatus.

Japanese Patent Application Publication No. 2011-39561 has proposed a developing cartridge which is provided with a drive-force receiving developing gear. The drive-force receiving developing gear receives an inputted drive force for driving the developing roller and the like.

SUMMARY

In the developing cartridge proposed in the above-described publication, two contact-receiving parts having a general L-shape in cross section are provided on the outer end-face of the drive-force receiving developing gear. Accordingly, when an advancing/retracting member inside the main casing is advanced and fitted into the drive-force receiving developing gear, engaging parts on the advancing/retracting member sometimes catch on the contact-receiving parts of the drive-force receiving developing gear.

It is conceivable to increase the size of the drive-force receiving developing gear, in order to increase the rigidity of the drive-force receiving developing gear. However, increasing the size of the drive-force receiving developing gear would require a larger amount of resin material for molding the gear. This could lead to an increase in the production costs for the developing cartridge.

In view of the foregoing, it is an object of the present invention to provide a developing cartridge capable of smoothly receiving a drive force from outside of the developing cartridge.

It is another object of the present invention to provide a developing cartridge capable of suppressing an increase in production costs.

In order to attain the above and other objects, the invention provides a developing cartridge including: an enclosure; a developing roller; and a drive-force receiving member. The enclosure may be configured to accommodate developer therein and may have a support part. The drive-force receiving member may be configured to receive a drive force from an outside of the developing cartridge and may be supported by the support part so as to be rotatable about a rotational axis relative to the support part. The drive-force receiving member may include: a first cylindrical part; a second cylindrical part; and a receiving part. The first cylindrical part may have a gear part configured to transmit a drive force to the developing roller. The second cylindrical part may be disposed radially inward of the first cylindrical part with a gap being formed between the first cylindrical part and the second cylindrical part. The second cylindrical part may be in contact with the support part. The receiving part may be configured to receive a drive force from the outside of the developing cartridge. The receiving part may be disposed outward of both of the first cylindrical part and the second cylindrical part in an axial direction in which the rotational axis extends. The receiving part may have an internal space that is in communication with the gap formed between the first cylindrical part and the second cylindrical part. The receiving part may be disposed such that the receiving part overlaps the gap between the first cylindrical part and the second cylindrical part when the receiving part is viewed in the axial direction. The receiving part may have an outward end in the axial direction, at least part of the outward end of the receiving part being closed.

According to another aspect, the present invention provides a developing cartridge including: an enclosure; a developing roller; and a drive-force receiving member. The enclosure may be configured to accommodate developer therein. The drive-force receiving member may include a receiving part and a gear part. The receiving part may have a receiving surface configured to receive a drive force from a drive source disposed in an outside of the developing cartridge. The gear part may be configured to transmit a drive force to the developing roller. The drive-force receiving member may be configured to rotate about a rotational axis. A radial direction may be defined orthogonal to the rotational axis. The receiving surface may include a first radial end farthest from the rotational axis in the radial direction and a second radial end closest to the rotational axis in the radial direction. A first distance may be defined as a distance between the first radial end and the second radial end of the receiving surface in a direction orthogonal to the axial direction. A second distance may be defined as a distance between the rotational axis and the first radial end of the receiving surface in the radial direction. The first distance may be smaller than or equal to ½ of the second distance.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
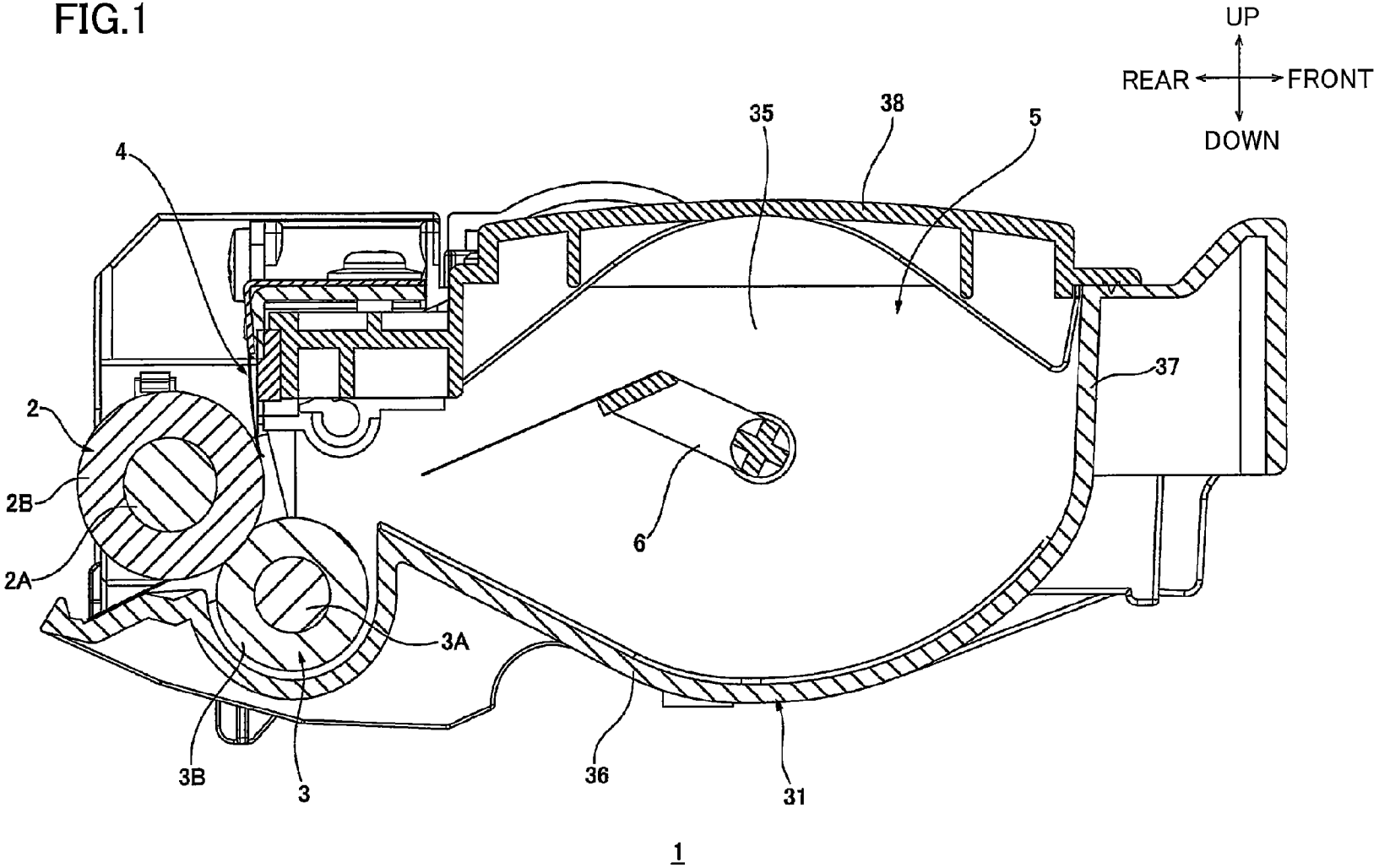
FIG. 1 is a central cross-sectional view of a developing cartridge according to an embodiment of the present invention.

A developing cartridge according to embodiments of the invention will be described while referring to the accompanying drawings wherein like parts and components are designated by the same reference numerals to avoid duplicating description.

1. Overall Structure of Developing Cartridge

As shown in FIG. 1, a developing cartridge 1 includes a developing roller 2, a supply roller 3, a thickness regulation blade 4, and a toner accommodating portion 5 as an example of an internal portion of an enclosure.

In the following description, directions will be specified based on the state of the developing cartridge 1 disposed in a horizontal orientation. Thus, the upper side in FIG. 1 will be considered the upper side of the developing cartridge 1, and the lower side in FIG. 1 will be considered the lower side of the developing cartridge 1. The right side in FIG. 1 will be considered the front side of the developing cartridge 1, and the left side in FIG. 1 will be considered the rear side of the developing cartridge 1. Further, left and right sides of the developing cartridge 1 will be defined based on the perspective of a user looking at the developing cartridge 1 from the front. Thus, the near side in FIG. 1 is the left side of the developing cartridge 1, and the far side in FIG. 1 is the right side of the developing cartridge 1. Leftward/rightward direction is an example of an axial direction.

The developing roller 2 is rotatably supported to a rear end portion of the developing cartridge 1. The developing roller 2 includes a developing-roller shaft 2A and a developing-roller body 2B.

The developing-roller shaft 2A extends in leftward/rightward direction and is generally columnar. The developing-roller shaft 2A is made from metal.

The developing-roller body 2B extends in leftward/rightward direction and is generally cylindrical. The developing-roller body 2B is made from electrically conductive rubber. The developing-roller body 2B does not cover left and right end portions of the developing-roller shaft 2A, but covers an intermediate portion thereof.

The supply roller 3 is positioned frontward and downward of the developing roller 2 and is rotatably supported to the developing cartridge 1. The supply roller 3 includes a supply-roller shaft 3A and a supply-roller body 3B.

The supply-roller shaft 3A extends in leftward/rightward direction and is generally columnar. The supply-roller shaft 3A is made from metal.

The supply-roller body 3B extends in leftward/rightward direction and is generally cylindrical. The supply-roller shaft 3A is made from electrically conductive sponge material. The supply-roller body 3B does not cover left and right end portions of the supply-roller shaft 3A, but covers an intermediate portion thereof. The supply-roller body 3B is in contact with a front lower portion of the developing-roller body 2B.

The thickness regulation blade 4 is positioned frontward and upward of the developing roller 2, and is in contact with a front end portion of the developing roller 2.

The toner accommodating portion 5 is positioned frontward of the supply roller 3 and the thickness regulation blade 4. The toner accommodating portion 5 is adapted to accommodate toner as an example of the developer. The toner accommodating portion 5 includes an agitator 6.

The agitator 6 is rotatably supported in the toner accommodating portion 5.

2. Operation of Developing Cartridge

Figure 2:
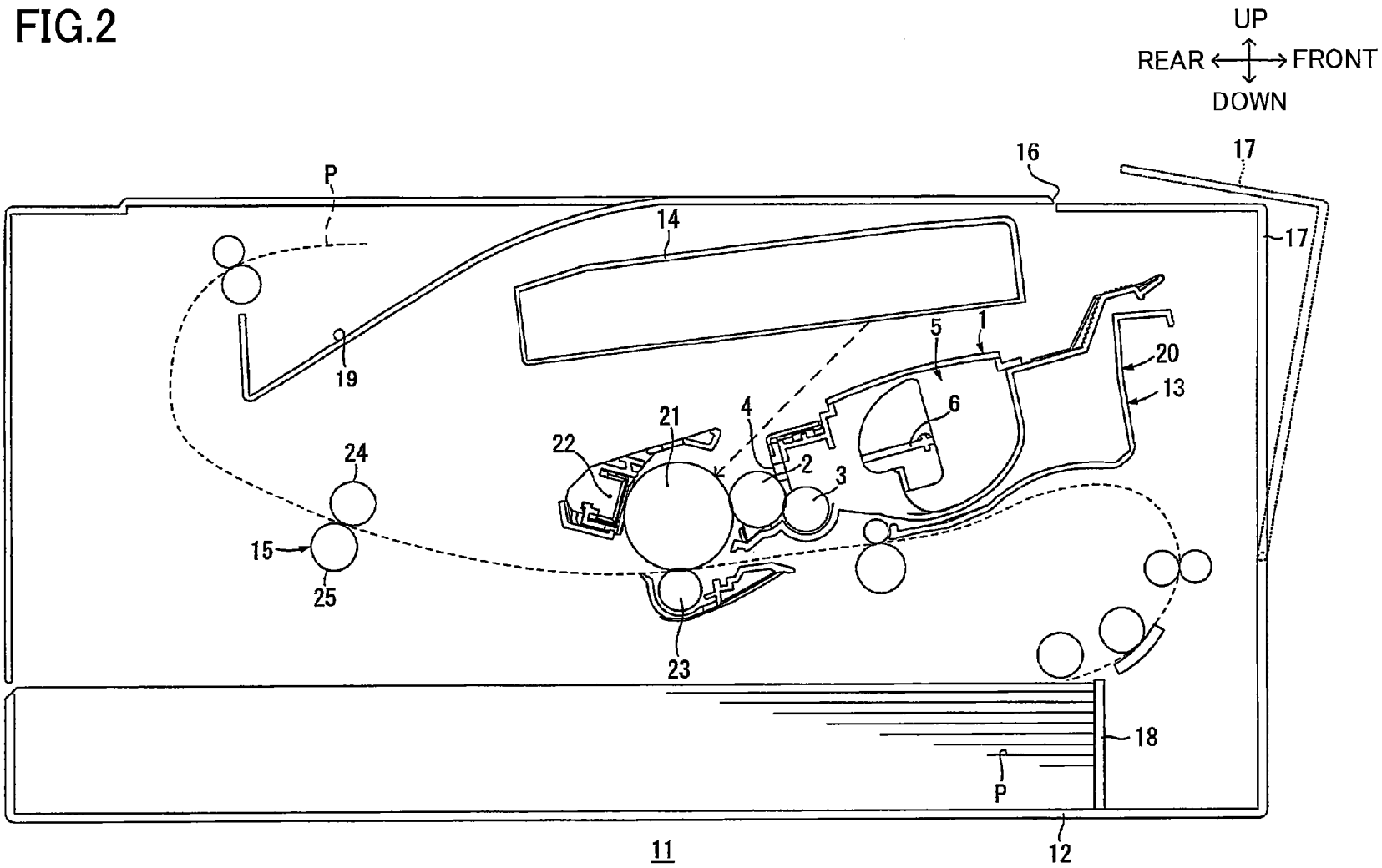
FIG. 2 is a central cross-sectional view of a printer in which the developing cartridge shown in FIG. 1 is mounted.

As shown in FIG. 2, the developing cartridge 1 is mounted in an image forming apparatus 11.

The image forming apparatus 11 is an electro-photographic type monochromatic printer, and includes an apparatus body 12 as an example of an outside of a developing cartridge, a process cartridge 13, a scanner unit 14, and a fixing unit 15.

The apparatus body 12 is generally box-shaped, and includes an opening portion 16, a front cover 17, a sheet supply tray 18, and a discharge tray 19.

The opening portion 16 is positioned at a front end portion of the apparatus body 12. The opening portion 16 provides communication between an interior and exterior of the apparatus body 12 in the front-rear direction for allowing the process cartridge 13 to pass through the opening portion 16.

The front cover 17 is positioned at a front end portion of the apparatus body 12, and is generally flat plate shaped. The front cover 17 extends in vertical direction and has a lower end portion pivotally supported to a front wall of the apparatus body 12. The front cover 17 is adapted to open and close the opening portion 16.

The sheet supply tray 18 is positioned at a bottom portion of the apparatus body 12. The sheet supply tray 18 is adapted to accommodate therein a stack of sheets P.

The discharge tray 19 is positioned at a rear half portion of a top wall of the apparatus body 12. The discharge tray 19 is recessed downward from a top surface of the apparatus body 12 so as to receive the sheet P.

The process cartridge 13 is accommodated at a vertically center portion of the apparatus body 12, and is attachable to and detachable from the apparatus body 12. The process cartridge 13 includes a drum cartridge 20 and the developing cartridge 1.

The drum cartridge 20 includes a photosensitive drum 21, a scorotron charger 22 and a transfer roller 23.

The photosensitive drum 21 is rotatably supported to a rear end portion of the drum cartridge 20.

The scorotron charger 22 is positioned rearward and upward of the photosensitive drum 21, and is spaced away from the photosensitive drum 21.

The transfer roller 23 is positioned below the photosensitive drum 21, and is in contact with a lower end portion of the photosensitive drum 21.

The developing cartridge 1 is attached to the drum cartridge 20 such that the developing cartridge 1 is positioned frontward of the photosensitive drum 21 and the developing roller 2 is in contact with a front end portion of the photosensitive drum 21.

The scanner unit 14 is positioned above the process cartridge 13. The scanner unit 14 is adapted to emit laser beam to the photosensitive drum 21 on a basis of image data.

The fixing unit 15 is positioned rearward of the process cartridge 13. The fixing unit 15 includes a heat roller 24 and a pressure roller 25 in pressure contact with a rear lower portion of the heat roller 24.

Upon start of the image forming operation in the image forming apparatus 11, the scorotron charger 22 uniformly charge a surface of the photosensitive drum 21, and the surface of the photosensitive drum 21 is exposed to light by the scanner unit 14. Thus, an electrostatic latent image based on the image data is formed on the surface of the photosensitive drum 21.

Further, the agitator 6 agitates toner in the toner accommodating portion 5, and supplies the toner to the supply roller 3. The supply roller 3 supplies toner from the toner accommodating portion 5 to the developing roller 2. At this time, toner is triboelectrically charged with positive polarity at a position between the developing roller 2 and the supply roller 3 and carried on the developing roller 2. The thickness regulation blade 4 regulates a thickness of a toner layer carried on the developing roller 2 into a uniform thickness.

The toner carried on the developing roller 2 is supplied to the surface of the photosensitive drum 21. Thus, a toner image corresponding to the electrostatic latent image is carried on the surface of the photosensitive drum 21.

Each sheet P is supplied to a portion between the photosensitive drum 21 and the transfer roller 23 at a prescribed timing by the rotation of various rollers. The toner image on the surface of the photosensitive drum 21 is transferred onto the sheet P when the sheet passes through the portion between the photosensitive drum 21 and the transfer roller 23.

Thereafter, the sheet P is heated and pressed when the sheet passes through a portion between the heat roller 24 and pressure roller 25. Thus, the toner image on the sheet P is thermally fixed to the sheet P. Then, the sheet P is discharged onto the discharge tray 19.

3. Detailed Description of the Developing Cartridge

Figure 3:
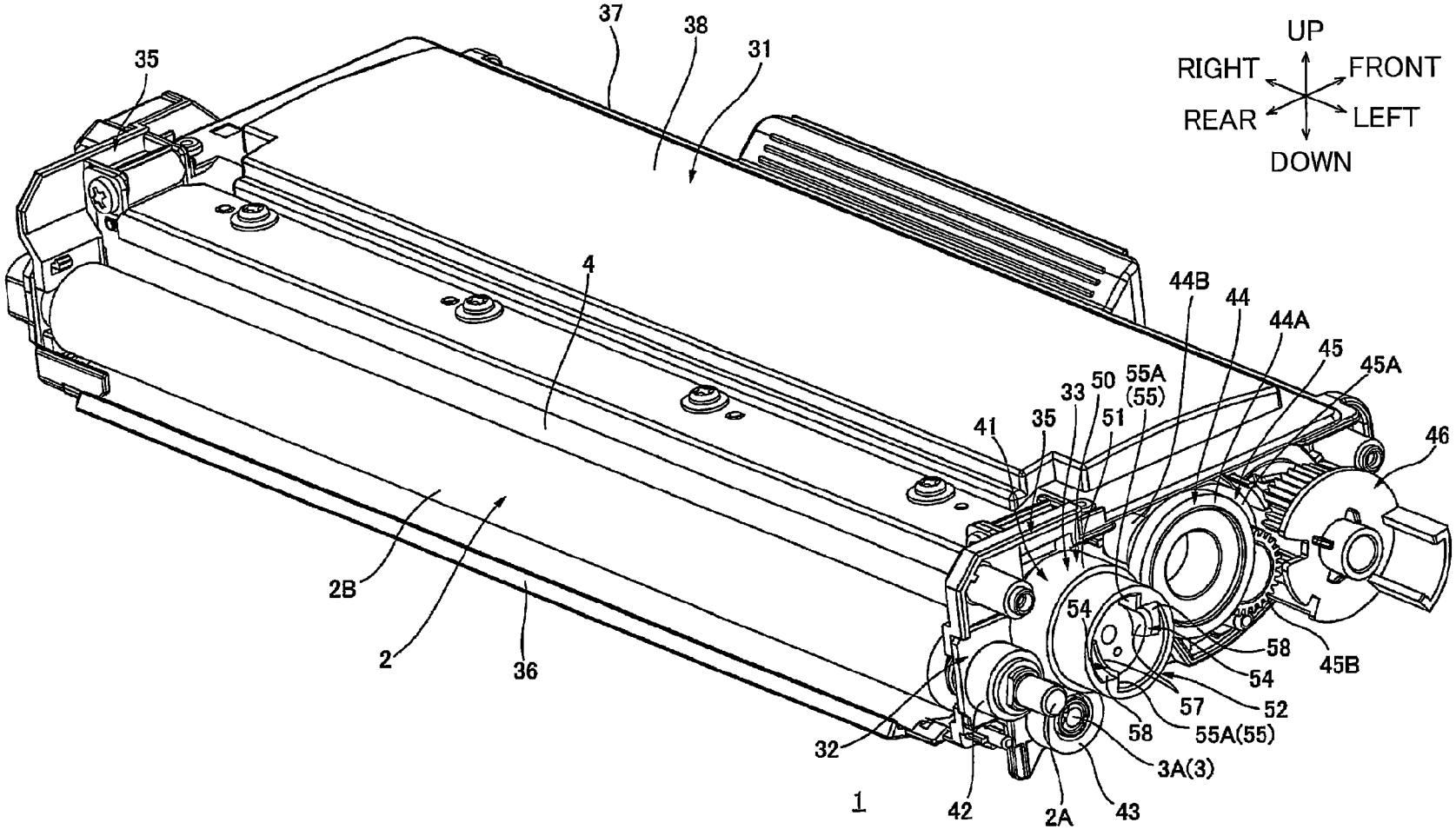
FIG. 3 is a perspective view of the developing cartridge shown in FIG. 1 as viewed from rear left side thereof, wherein showing of a gear cover is omitted in order to show a gear train.

As shown in FIG. 3, the developing cartridge 1 includes a developing-cartridge frame 31 as an example of the enclosure, and a gear train 33.

(1) Developing-Cartridge Frame

As shown in FIGS. 1 and 3, the developing-cartridge frame 31 has a box-like shape. The developing-cartridge frame 31 includes a pair of side walls 35, a bottom wall 36, a front wall 37, a top wall 38, and a bearing member 32.

The side walls 35 are arranged with one on each of the left and right ends of the developing-cartridge frame 31. The side walls 35 are plate-shaped and have a general rectangular shape in a side view that is elongated in the front-rear and vertical directions.

The bottom wall 36 has a general plate shape that is elongated in the front-rear and left-right directions. The left and right ends of the bottom wall 36 are formed continuously with the bottom edges of the corresponding side walls 35.

The front wall 37 has a general plate shape that is elongated in the vertical and left-right directions. The bottom edge of the front wall 37 is formed continuously with the front edge of the bottom wall 36. The left and right edges of the front wall 37 are formed continuously with the front edges on the corresponding side walls 35.

The top wall 38 is formed in a general plate shape that is elongated in the front-rear and left-right directions. The front edge of the top wall 38 is formed continuously with the top edge of the front wall 37. The left and right edges of the top wall 38 are formed continuously with the top edges of the corresponding side walls 35.

Figure 5:
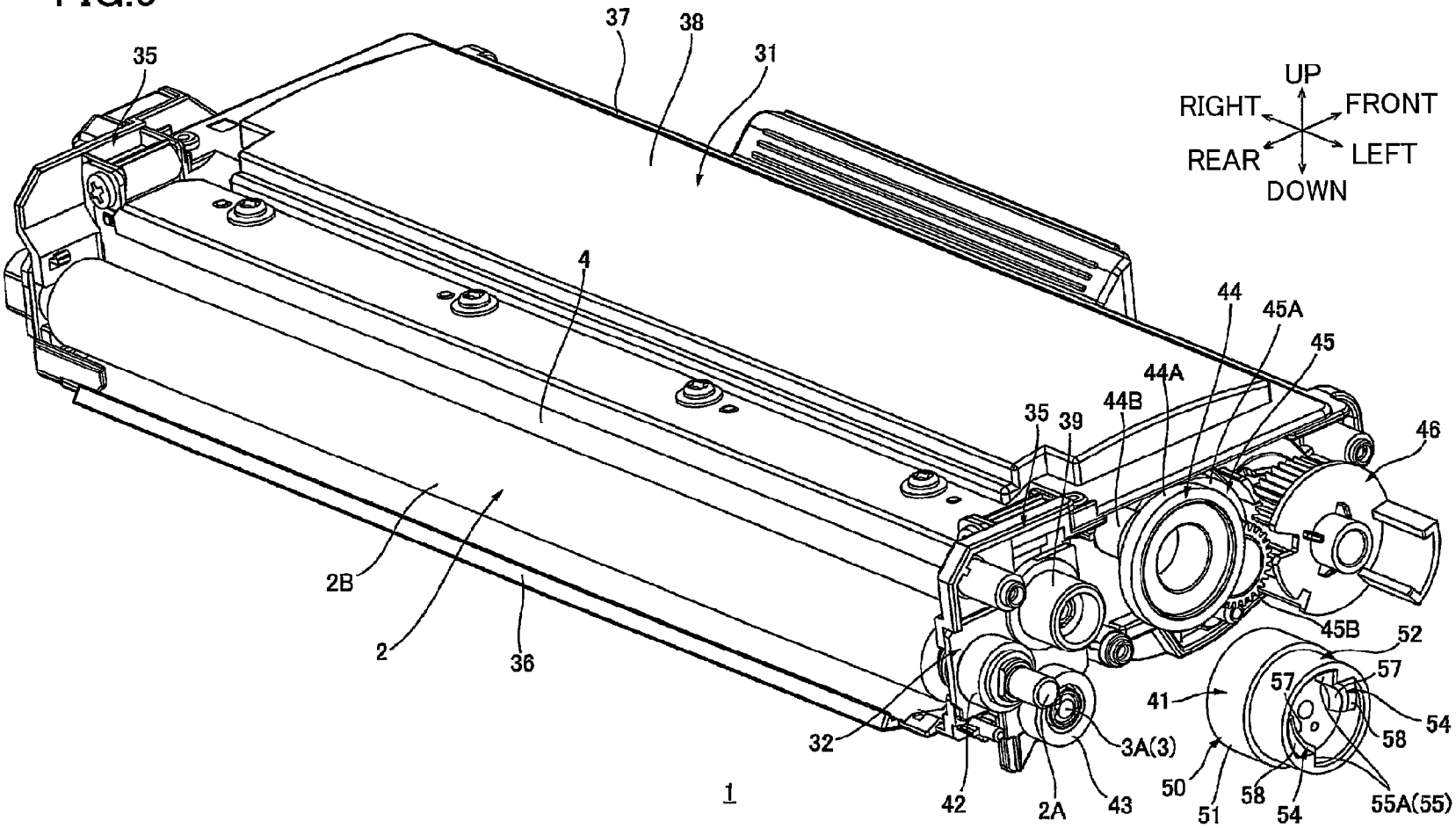
FIG. 5 is a view of the developing cartridge in a state where a developing coupling is detached.

As shown in FIG. 5, the bearing member 32 is supported on the rear side of the left side wall 35. The bearing member 32 has a plate shape that is generally rectangular in a side view. The bearing member 32 rotatably supports the developing-roller shaft 2A in its rear side and rotatably supports the supply-roller shaft 3A in its lower side. The bearing member 32 has a coupling support boss 39 as an example of the support part in the invention.

The coupling support boss 39 is disposed in the upper front corner of the bearing member 32. The coupling support boss 39 has a general cylindrical shape and protrudes leftward from the left surface of the bearing member 32.

(2) Gear Train

Figure 4:
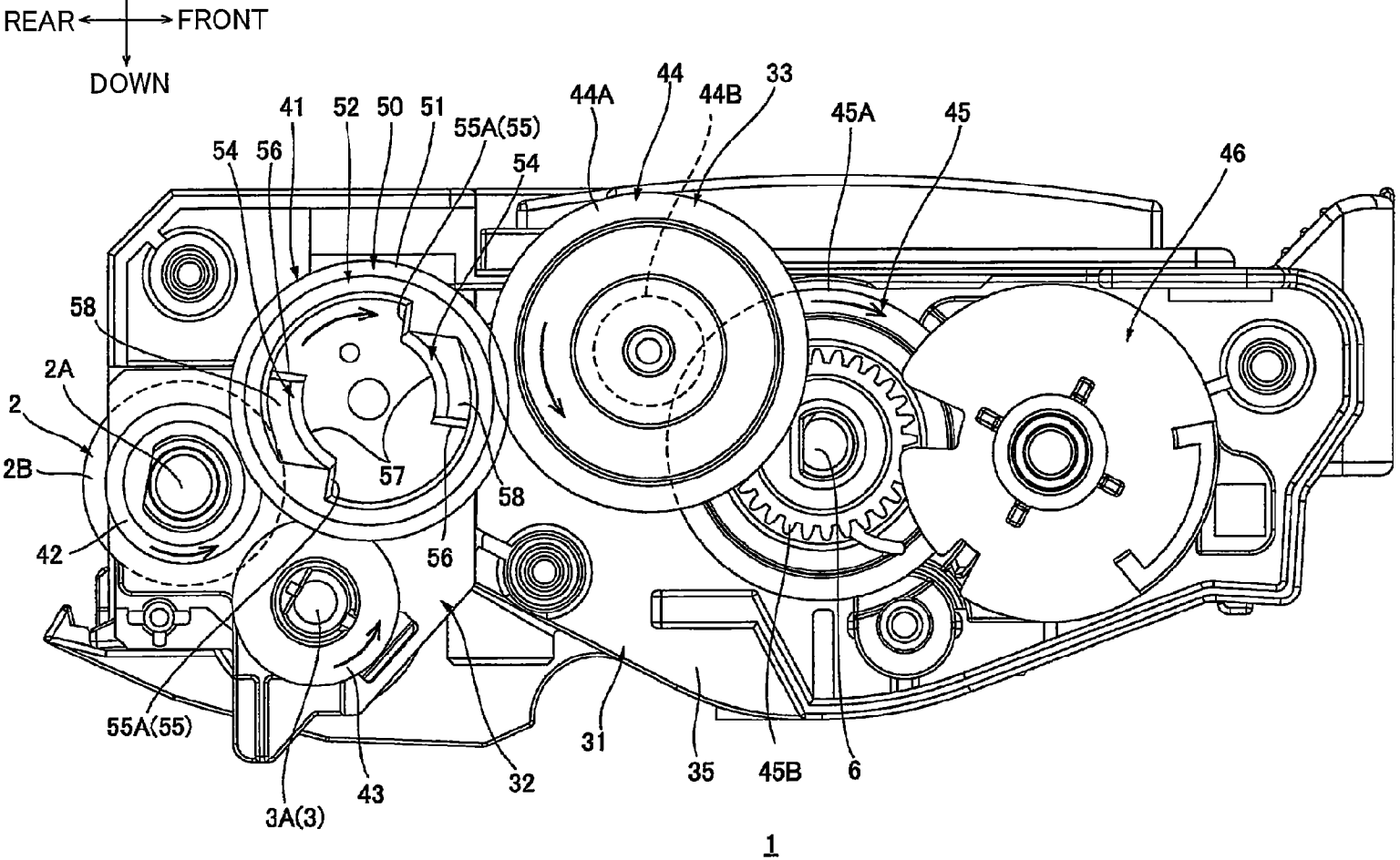
FIG. 4 is a left side view of the developing cartridge shown in FIG. 3.

As shown in FIGS. 3 and 4, the gear train 33 is disposed on the left end of the developing cartridge 1, further leftward than the developing-cartridge frame 31. Note that the gear train 33 is covered by a gear cover not shown in the drawing. The gear train 33 includes a developing coupling 41 as an example of the drive-force receiving member, a developing gear 42, a supply gear 43, an idle gear 44, an agitator gear 45, and a sensor gear 46.

(2-1) Developing Coupling

Figure 6:
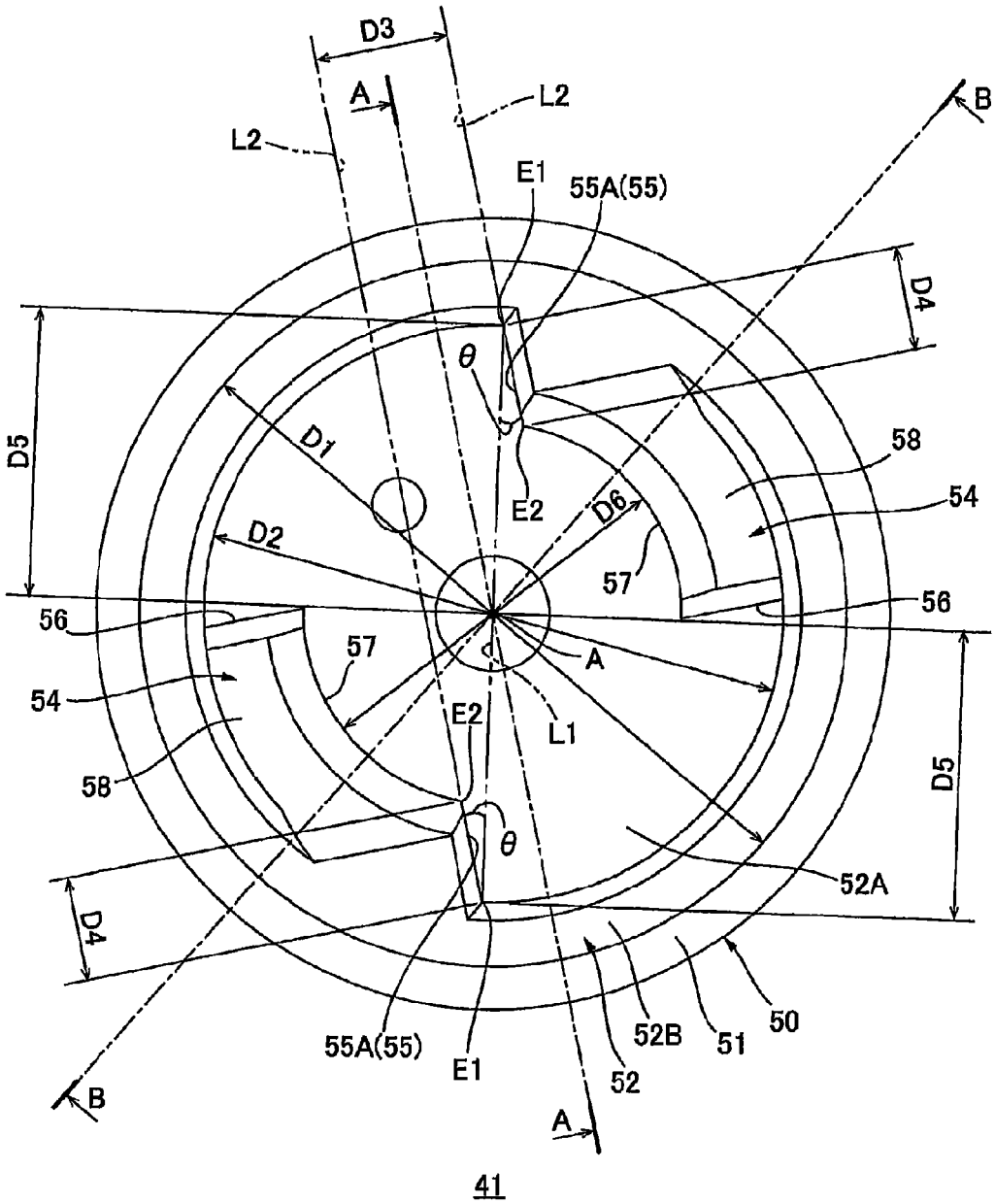
FIG. 6 is a left side view of the developing coupling shown in FIG. 5.
Figure 8A:
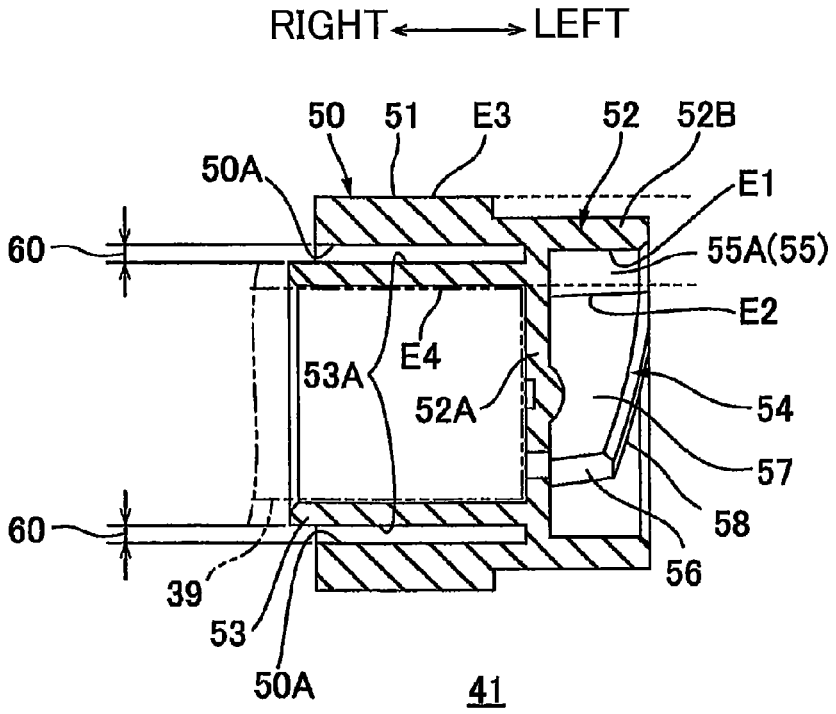
FIG. 8A is a cross-sectional view of the developing coupling taken along a line A-A in FIG. 6.

The developing coupling 41 is disposed near the rear end on the left side of the developing cartridge 1. The developing coupling 41 has a general columnar shape that is elongated in the left-right direction. The rear portion of the developing coupling 41 overlaps the developing-roller body 2B of the developing roller 2 in a left-right projection. In other words, the rear portion of the developing coupling 41 overlaps the developing-roller body 2B when the developing coupling 41 is viewed in the left-right direction. As shown in FIGS. 6 and 8A, the developing coupling 41 includes a first cylindrical part 50, a second cylindrical part 53, and a coupling part 52.

The first cylindrical part 50 constitutes the approximate right half of the developing coupling 41. The first cylindrical part 50 has a general cylindrical shape that is elongated in the left-right direction. The central axis A of the first cylindrical part 50 is also the central axis of the developing coupling 41. The first cylindrical part 50 has a gear-tooth part 51.

The gear-tooth part 51 is disposed around the entire outer circumference of the first cylindrical part 50. The gear-tooth part 51 includes gear teeth.

Figure 7:
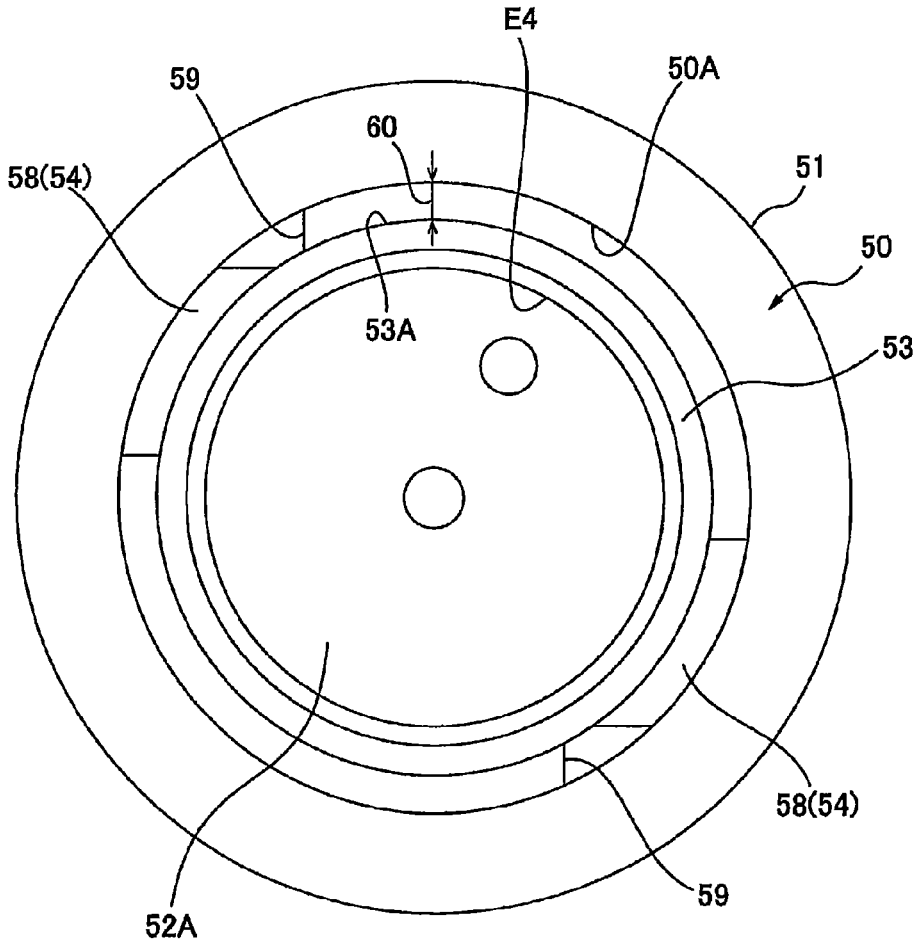
FIG. 7 is a right side view of the developing coupling shown in FIG. 5.

As shown in FIGS. 7 and 8A, the second cylindrical part 53 is disposed radially inside the first cylindrical part 50. The second cylindrical part 53 has a general cylindrical shape and is elongated in the left-right direction. The second cylindrical part 53 shares the central axis A with the first cylindrical part 50. The outer diameter of the second cylindrical part 53 is smaller than the inner diameter of the first cylindrical part 50. The inner diameter of the second cylindrical part 53 is approximately the same as the outer diameter of the coupling support boss 39. A gap 60 is formed between an outer circumferential surface 53A of the second cylindrical part 53 and an inner circumferential surface 50A of the first cylindrical part 50. The right end of the second cylindrical part 53 protrudes farther rightward than the right end of the gear-tooth part 51. The second cylindrical part 53 is fitted around the radial outer side of the coupling support boss 39 provided on the developing-cartridge frame 31 and is capable of rotating relative to the coupling support boss 39. The inner circumferential surface of the second cylindrical part 53 is in contact with the outer circumferential surface of the coupling support boss 39.

Figure 8B:
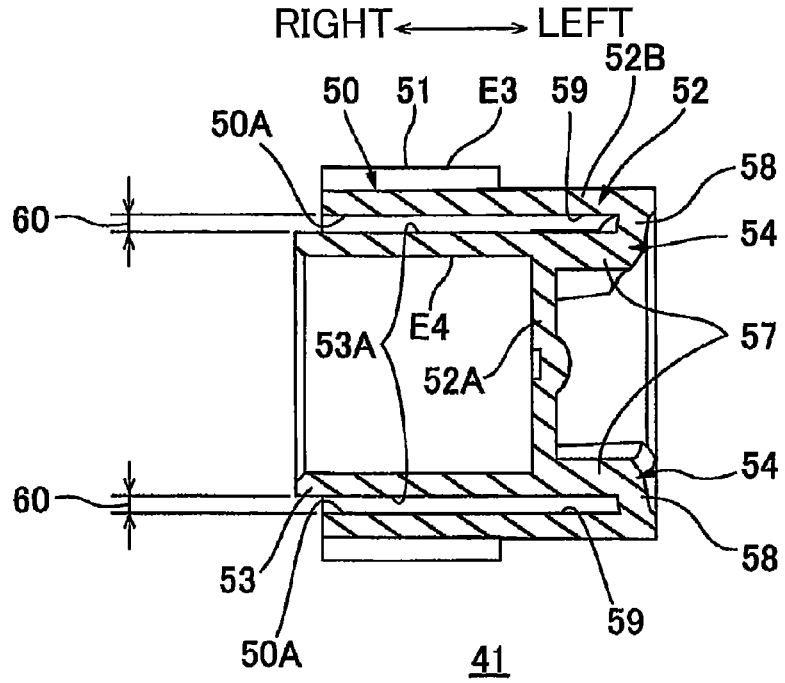
FIG. 8B is a cross-sectional view of the developing coupling taken along a line B-B in FIG. 6.

As shown in FIGS. 6, 8A, and 8B, the coupling part 52 constitutes the approximate left half of the developing coupling 41. The coupling part 52 has a general cylindrical shape that is elongated in the left-right direction and closed on the right end. The coupling part 52 shares the central axis A with the first cylindrical part 50. The coupling part 52 includes a base part 52A, a third cylindrical part 52B, and a pair of engaging parts 54 as examples of the receiving part in the invention.

The base part 52A is disposed on the right end of the coupling part 52 and constitutes the right wall of the same. The base part 52A has a disc-like shape that is aligned with radial directions of the coupling part 52. The right surface of the base part 52A is formed continuously with the left edges of the first cylindrical part 50 and second cylindrical part 53. Thus, the base part 52A closes the left sides of the first cylindrical part 50 and second cylindrical part 53.

The third cylindrical part 52B has a general cylindrical shape that extends leftward from the peripheral edge of the base part 52A and constitutes the circumferential wall of the coupling part 52. The outer diameter of the third cylindrical part 52B is smaller than the diameter of the addendum circle E3 described by the gear teeth of the gear-tooth part 51. The inner diameter of the third cylindrical part 52B is larger than the outer diameter of the second cylindrical part 53. Specifically, the outer diameter D1 of the third cylindrical part 52B is 19.6 mm, and the inner diameter D2 of the same is 16.05 mm.

The engaging parts 54 are disposed on opposing sides of the central axis A along a radial direction of the coupling part 52. The engaging parts 54 have a general trapezoidal shape in a side view that protrudes radially inward from the inner circumferential surface of the coupling part 52 and that extends along the circumferential direction of the coupling part 52. Each of the engaging parts 54 has an upstream wall 55 as an example of the first wall, a downstream wall 56 as an example of the third wall, an inner circumferential wall 57 as an example of the second wall, and a left wall 58 as an example of the fourth wall.

The upstream wall 55 is provided on the upstream end of the corresponding engaging part 54 with respect to the clockwise direction in a left side view. The upstream wall 55 extends from the inner peripheral surface of the third cylindrical part 52B toward inward in an orthogonal direction. The orthogonal direction is orthogonal to an axial direction, in which the central axis A of the coupling part 52 extends, and does not pass through the central axis A of the coupling part 52. The upstream wall 55 is directed in the leftward/rightward direction. The right edge of the upstream wall 55 is formed continuously with the base part 52A. The left edge of the upstream wall 55 is beveled such that the surface of the left edge of the upstream wall 55 slopes toward downstream in the clockwise direction of a left side view while proceeding to the left.

The upstream wall 55 has an engaging surface 55A as an example of the receiving surface. The engaging surface 55A is the surface of part of the upstream wall 55 that is disposed on the upstream end in the clockwise direction of a left side view. In other words, the engaging surface 55A is the surface of a main part of the upstream wall 55 that is other than the beveled left edge thereof. The engaging surface 55A is directed in the leftward/rightward direction. As shown in FIG. 6, the engaging surface 55A is oriented such that the engaging surface 55A slopes from an outer radial edge E1 toward downstream in the clockwise direction of a left side view, while progressing toward the central axis A of the coupling part 52. The outer radial edge E1 serves as an example of the first radial end. A virtual line L1 connecting the outer radial edges E1 on the engaging surfaces 55A of the respective engaging parts 54 passes through the central axis A of the coupling part 52. The angle θ formed between the engaging surface 55A and the virtual line L1 is greater than or equal to 5 degrees and smaller than or equal to 20 degrees, for example, and specifically 15.3 degrees in the embodiment. Virtual lines L2 forming extensions to the engaging surfaces 55A of the corresponding engaging parts 54 are parallel to each other and separated by a gap D3 and do not pass through the central axis A of the coupling part 52. A distance D4 between the outer radial edge E1 and an inner radial edge E2 of the engaging surface 55A serving as an example of the second radial end is greater than or equal to ⅛ of a distance D5 between the outer radial edge E1 of the engaging surface 55A and the central axis A of the coupling part 52, for example. The distance D4 is smaller than or equal to ½ of the distance D5, for example, and is preferably smaller than or equal to $\frac{1}{2.8}$ of the distance D5. In other words, it is preferable that the distance D4 is greater than or equal to ⅛ of the distance D5 and smaller than or equal to ½ of the distance D5. It is more preferable that the distance D4 is greater than or equal to ⅛ of the distance D5 and smaller than or equal to $\frac{1}{2.8}$ of the distance D5. The distance D4 is greater than or equal to 2.8 mm and smaller than or equal to 2.95 mm, for example, and specifically 2.87 mm in the embodiment. The distance D5 is specifically 8.025 mm in the embodiment.

Further, the outer radial edge E1 of the engaging surface 55A is positioned radially inward of the addendum circle E3 described by the gear teeth formed on the gear-tooth part 51, and radially outward of an inner circumferential surface E4 of the second cylindrical part 53. The inner radial edge E2 of the engaging surface 55A is disposed radially inward of the inner circumferential surface E4 formed on the second cylindrical part 53. Hence, the inner radial edge E2 of the engaging surface 55A is positioned further inward radially than the outer circumferential surface of the coupling support boss 39.

The downstream wall 56 is disposed on the end of the respective engaging parts 54 downstream in the clockwise direction of a left side view. The downstream wall 56 extends from the inner circumferential surface of the third cylindrical part 52B toward inward substantially in the radial direction of the coupling part 52. The downstream wall 56 is directed in the leftward/rightward direction. The right edge of the downstream wall 56 is formed continuously with the base part 52A. The left edge of the downstream wall 56 is positioned further rightward than the left edge of the upstream wall 55. The left edge of the downstream wall 56 is beveled such that the surface of the left edge of the downstream wall 56 slopes toward upstream in the clockwise direction of a left side view while proceeding to the left.

The inner circumferential wall 57 is provided on the radial inside of the engaging part 54. The inner circumferential wall 57 is separated in a direction radially inward from the third cylindrical part 52B. The inner circumferential wall 57 has an arc shape centered on the central axis A of the coupling part 52. The end of the inner circumferential wall 57 upstream in the clockwise direction of a left side view is formed continuously with the inside end of the upstream wall 55. An inner diameter D6 of the inner circumferential walls 57, that is, the distance between the opposing inner circumferential walls 57, is specifically 10.55 mm in the embodiment. The end of the inner circumferential wall 57 that is downstream in the clockwise direction of a left side view is formed continuously with the inside end of the downstream wall 56. The inner circumferential wall 57 is directed in the leftward/rightward direction. The right edge of the inner circumferential wall 57 is formed continuously with the base part 52A. The left edge of the inner circumferential wall 57 is beveled such that the surface of the left edge of the inner circumferential wall 57 slopes toward radially outward in the radial direction of the coupling part 52 while proceeding to the left.

The left wall 58 is disposed on the left end of the corresponding engaging part 54. The left wall 58 is elongated in the circumferential direction of the coupling part 52, with its width being aligned with the radial directions of the coupling part 52. The upstream end of the left wall 58 in the clockwise direction of a left side view is formed continuously with the left end of the upstream wall 55. The downstream end of the left wall 58 in the clockwise direction of a left side view is formed continuously with the left end of the downstream wall 56. The inner radial end of the left wall 58 is formed continuously with the left end of the inner circumferential wall 57. The outer radial end of the left wall 58 is formed continuously with the inner peripheral surface of the third cylindrical part 52B. The left wall 58 slopes rightward along the clockwise direction of a left side view. The left wall 58 closes the left end of the engaging part 54 and, along with the upstream wall 55, downstream wall 56, inner circumferential wall 57, and third cylindrical part 52B, defines an internal space 59 of the corresponding engaging part 54. The internal spaces 59 of both engaging parts 54 penetrate the base part 52A so as to connect with the gap 60 formed between the second cylindrical part 53 and the first cylindrical part 50.

As shown in FIG. 8B, the engaging parts 54 overlap the gap 60 between the second cylindrical part 53 and the first cylindrical part 50 in a left-right projection. In other words, the engaging parts 54 overlap the gap 60 when the engaging parts 54 are viewed in the leftward/rightward direction, that is, in the axial direction. The engaging parts 54, along with the third cylindrical part 52B, constitute a combined structure that bridges the first cylindrical part 50 and the second cylindrical part 53 such that the internal spaces 59 of the engaging parts 54 are in communication with the gap 60 between the first cylindrical part 50 and the second cylindrical part 53.

As shown in FIGS. 3 and 4, the developing gear 42 is disposed on the lower rear side of the developing coupling 41. The developing gear 42 has a disc-like shape with substantial thickness in the left-right direction. Gear teeth are provided around the entire circumference of the developing gear 42. The developing gear 42 is supported on the left end of the developing-roller shaft 2A so as to be incapable of rotating relative to the same. The developing gear 42 is engaged with the gear-tooth part 51 of the developing coupling 41 from the lower rear side.

The supply gear 43 is disposed below the developing coupling 41. The supply gear 43 has a disc-like shape with substantial thickness in the left-right direction. Gear teeth are provided around the entire circumference of the supply gear 43. The supply gear 43 is supported on the left end of the supply-roller shaft 3A so as to be incapable of rotating relative to the same. The supply gear 43 is engaged with the gear-tooth part 51 of the developing coupling 41 from the bottom thereof.

The idle gear 44 is disposed on the front side of the developing coupling 41. The idle gear 44 is rotatably supported on the left side wall 35 of the developing-cartridge frame 31. The idle gear 44 is integrally provided with a large-diameter gear 44A, and a small-diameter gear 44B.

The large-diameter gear 44A constitutes the left portion of the idle gear 44. The large-diameter gear 44A has a disc-like shape with substantial thickness in the left-right direction. Gear teeth are provided around the entire circumference of the large-diameter gear 44A. The large-diameter gear 44A is engaged with the gear-tooth part 51 of the developing coupling 41 from the front side thereof.

The small-diameter gear 44B has a general columnar shape that extends rightward from the right surface of the large-diameter gear 44A. The small-diameter gear 44B shares a central axis with the large-diameter gear 44A. The small-diameter gear 44B has a smaller outer diameter than that of the large-diameter gear 44A. Gear teeth are provided around the entire circumference of the small-diameter gear 44B.

The agitator gear 45 is disposed on the lower front side of the idle gear 44. The agitator gear 45 has a first gear part 45A, and a second gear part 45B.

The first gear part 45A constitutes the right half of the agitator gear 45. The first gear part 45A has a disc-like shape with substantial thickness in the left-right direction. Gear teeth are provided around the entire circumference of the first gear part 45A. The first gear part 45A is engaged with the small-diameter gear 44B of the idle gear 44 from the front side thereof.

The second gear part 45B constitutes the left half of the agitator gear 45. The second gear part 45B has a disc-like shape with substantial thickness in the left-right direction and overlaps the left surface of the first gear part 45A. The second gear part 45B shares a central axis with the first gear part 45A. The second gear part 45B has a smaller outer diameter than that of the first gear part 45A. Gear teeth are provided around the entire circumference of the second gear part 45B.

The sensor gear 46 is disposed on the front side of the agitator gear 45. The sensor gear 46 has a disc-like shape with substantial thickness in the left-right direction. The sensor gear 46 is a partially-toothed gear having gear teeth on only a portion of its circumferential surface. When the developing cartridge 1 is first mounted in the apparatus body 12, the sensor gear 46 engages with the second gear part 45B of the agitator gear 45 and rotates until becoming disengaged from the second gear part 45B and coming to a halt. By detecting this rotation of the sensor gear 46, the apparatus body 12 can determine that the developing cartridge 1 has not been used.

4. Apparatus-Side Coupling

Figure 9:
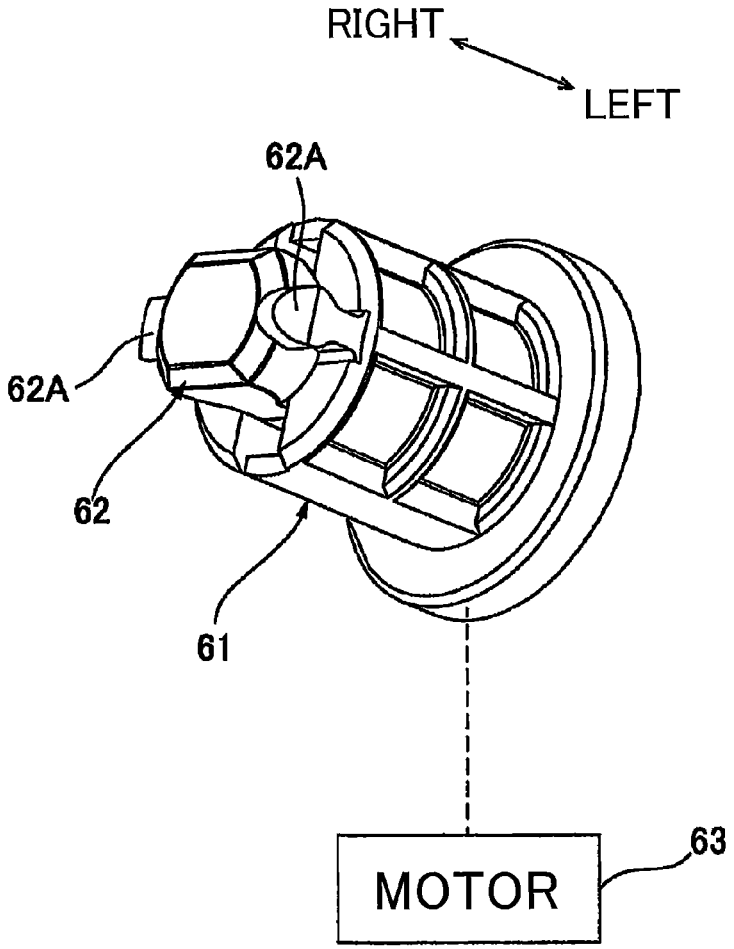
FIG. 9 is a perspective view of an apparatus-side coupling as viewed from right lower side thereof.

As shown in FIG. 9, the apparatus body 12 of the image forming apparatus 11 is further provided with an apparatus-side coupling 61, and a motor 63 serving as an example of the drive source. The apparatus-side coupling 61 is disposed inside the apparatus body 12 to the left of the developing cartridge 1. The apparatus-side coupling 61 is in a substantially columnar shape extending in the left-right direction. The apparatus-side coupling 61 operates in association with the opening and closing operation of the front cover 17. That is, the apparatus-side coupling 61 retracts leftward away from the developing cartridge 1 when the front cover 17 is opened, and advances rightward toward the developing cartridge 1 when the front cover 17 is closed. The apparatus-side coupling 61 is connected to the motor 63 and is capable of transmitting a drive force from the same. The apparatus-side coupling 61 is provided with an engaging part 62.

The engaging part 62 is disposed on the right end of the apparatus-side coupling 61. The engaging part 62 has a general columnar shape and protrudes rightward from the right end of the apparatus-side coupling 61. The engaging part 62 has a pair of engaging protrusions 62A.

The engaging protrusions 62A are columnar-shaped and have a general rectangular shape in a side view. The engaging protrusions 62A extend radially outward from diametrically opposing side surfaces of the engaging part 62.

5. Drive Operation for the Developing Cartridge

Figure 10A:
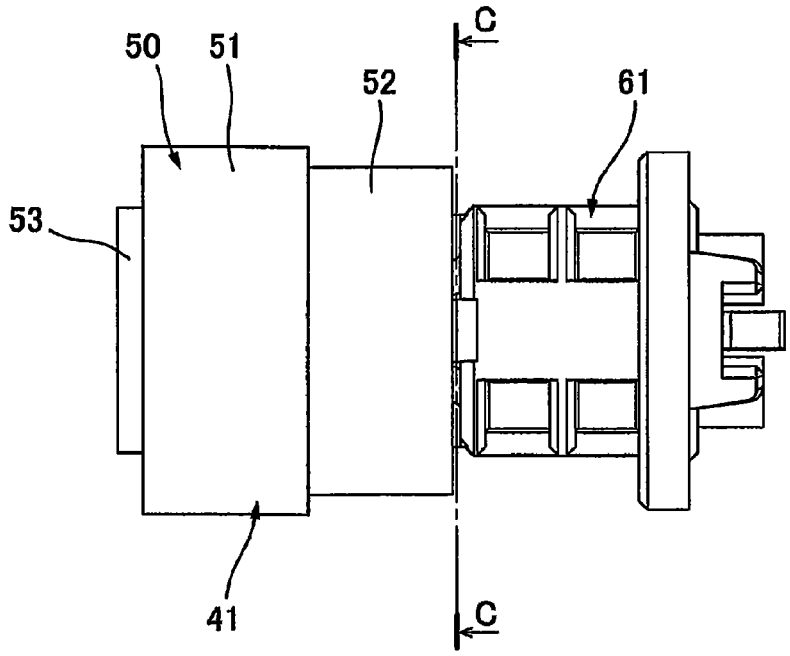
FIG. 10A is a plan view showing a state where the apparatus-side coupling is coupled to the developing coupling.
Figure 10B:
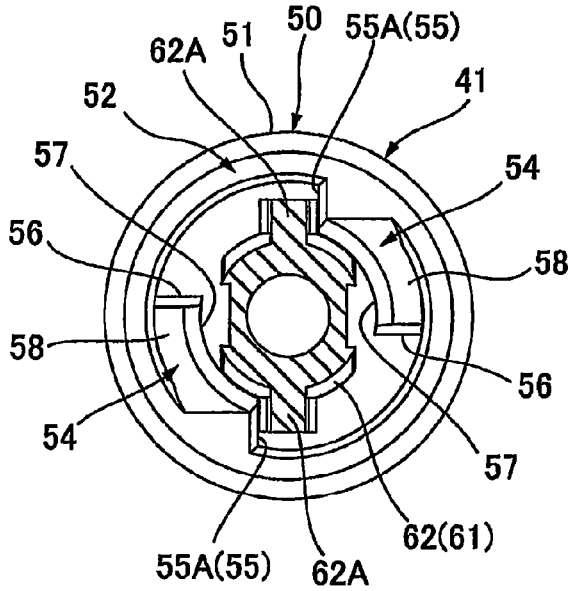
FIG. 10B is a cross-sectional view taken along a line C-C in FIG. 10A.

After mounting the developing cartridge 1 in the apparatus body 12, the operator closes the front cover 17. As the front cover 17 is closed, the apparatus-side coupling 61 advances toward the developing cartridge 1. At this time, the engaging part 62 of the apparatus-side coupling 61 becomes fitted into the coupling part 52 of the developing coupling 41, as shown in FIGS. 10A and 10B.

Since the left ends of the engaging parts 54 in the developing coupling 41 are closed by the corresponding left walls 58, the engaging protrusions 62A of the apparatus-side coupling 61 do not catch in the internal spaces 59 of the engaging parts 54, but rather are guided along the sloped surfaces of the left walls 58 in the clockwise direction of a left side view as the engaging part 62 is fitted into the coupling part 52. Consequently, the engaging protrusions 62A come face to face with the corresponding engaging parts 54 of the developing coupling 41 in the circumferential direction.

When the motor 63 in the apparatus body 12 outputs a drive force for rotating the apparatus-side coupling 61 clockwise in a left side view, the engaging protrusions 62A of the apparatus-side coupling 61 contact the corresponding engaging surfaces 55A of the developing coupling 41 from the upstream side in the clockwise direction of a left side view.

As the apparatus-side coupling 61 rotates in this state, the developing coupling 41 rotates clockwise in a left side view together with the apparatus-side coupling 61, as illustrated in FIG. 4.

When the developing coupling 41 rotates, the developing gear 42, supply gear 43, and idle gear 44 rotate counterclockwise in a left side view. Consequently, the developing roller 2 and supply roller 3 also rotate counterclockwise in a left side view.

Further, as the idle gear 44 rotates, the agitator gear 45 rotates clockwise in a left side view. Consequently, the agitator 6 also rotates clockwise in a left side view.

6. Operation (1) In the developing cartridge 1 of the embodiment described above, as shown in FIGS. 7 and 8B, the left walls 58 close the left ends of the corresponding engaging parts 54. Accordingly, the apparatus-side coupling 61 inside the apparatus body 12 is guided along the sloped surfaces of the left walls 58 in the clockwise direction of a left side view, without the engaging protrusions 62A of the apparatus-side coupling 61 catching in the internal spaces 59 of the engaging parts 54. Accordingly, the apparatus-side coupling 61 can be smoothly fitted inside the coupling part 52 of the developing coupling 41, and the drive force from the apparatus body 12 can be smoothly received by the developing coupling 41.

The gap 60 formed between the first cylindrical part 50 having the gear-tooth part 51 and the second cylindrical part 53 positioned radially inward of and apart from the corresponding first cylindrical part 50 is connected to the internal spaces 59 in the engaging parts 54.

Accordingly, a die having a continuous shape that corresponds to the gap 60 between the first cylindrical part 50 and second cylindrical part 53, and the internal spaces 59 in the engaging parts 54 can be used to mold the first cylindrical part 50 and second cylindrical part 53 individually with precision, and to mold the engaging parts 54 so as to be shaped with closed left ends. Thus, this arrangement enables the developing coupling 41 to be molded efficiently.

(2) As shown in FIG. 8A, the outer radial edge E1 of the engaging surface 55A is positioned radially inward from the addendum circle E3 described by the gear teeth of the gear-tooth part 51, and radially outward from the second cylindrical part 53. Accordingly, the engaging parts 54 can be disposed between the second cylindrical part 53 fitted around the coupling support boss 39, and the gear-tooth part 51 in the radial direction of the developing coupling 41.

Here, the second cylindrical part 53 has high rigidity in order to rotate the developing coupling 41 with stability. The gear-tooth part 51 also has high rigidity so as to be able to transmit a drive force reliably. Accordingly, by disposing the engaging parts 54 between the second cylindrical part 53 and gear-tooth part 51, both of which have high rigidity, this arrangement ensures the overall rigidity of the developing coupling 41. Consequently, the developing coupling 41 can stably receive a drive force.

(3) As shown in FIG. 4, the developing coupling 41 overlaps the developing-roller body 2B in a left-right projection. In other words, the developing coupling 41 overlaps the developing-roller body 2B when the developing coupling 41 is viewed in the left-right direction. Thus, the developing coupling 41 can be arranged efficiently.

(4) As shown in FIG. 8A, the outer circumferential surface of the coupling support boss 39 is positioned radially outward from the inner radial edge E2 of the engaging surface 55A. Accordingly, the coupling support boss 39 can be arranged so as to overlap the engaging surface 55A in a left-right projection. In other words, the coupling support boss 39 can be arranged such that the coupling support boss 39 overlaps the engaging surface 55A when the coupling support boss 39 is viewed in the left-right direction.

With this arrangement, it is possible to increase the outer diameter of the coupling support boss 39 relative to the outer diameter of the developing coupling 41 in order to ensure the rigidity of the coupling support boss 39. Thus, this configuration ensures that the developing coupling 41 is rotated with stability.

(5) As shown in FIG. 6, the engaging parts 54 have a general trapezoidal shape in a side view and extend along the circumferential direction of the coupling part 52. Each engaging part 54 includes the upstream wall 55, downstream wall 56, inner circumferential wall 57, and left wall 58. This arrangement ensures that the engaging parts 54 reliably and smoothly receive a drive force from the apparatus body 12, while making it possible to mold the developing coupling 41 efficiently.

(6) The distance D4 between the outer radial edge E1 and inner radial edge E2 of each engaging surface 55A is set no greater than ½ of the distance D5 between the outer radial edge E1 of the engaging surface 55A and the central axis A of the coupling part 52, as illustrated in FIG. 6. In this way, the developing coupling 41 can be made larger while suppressing an increase in the radial dimension of the engaging parts 54. Accordingly, this configuration can suppress an increase in the amount of resin material used for forming the engaging parts 54 and, hence, can suppress an increase in the quantity of resin material used for forming the developing coupling 41.

Thus, the above configuration suppresses an increase in the production costs for the developing cartridge 1.

(7) As shown in FIG. 6, the distance D4 between the outer radial edge E1 and inner radial edge E2 of the engaging surface 55A is set no greater than $1/2.8$ of the distance D5 between the outer radial edge E1 of the engaging surface 55A and the central axis A of the coupling part 52. Accordingly, it is possible to better suppress an increase in the quantity of resin material used for forming the engaging parts 54 and, hence, can better suppress an increase in production costs for the developing cartridge.

(8) As shown in FIG. 6, the distance D4 between the outer radial edge E1 and inner radial edge E2 of the engaging surface 55A is set to at least ⅛ of the distance D5 between the outer radial edge E1 of the engaging surface 55A and the central axis A of the coupling part 52. This configuration ensures that the engaging surfaces 55A are wide enough to receive a drive force stably.

(9) In the developing cartridge 1 of the embodiment, the distance D4 between the outer radial edge E1 and inner radial edge E2 of each engaging surface 55A is set between 2.8 mm and 2.95 mm. This setting ensures that the engaging surfaces 55A are sufficiently wide, while suppressing an increase in the quantity of resin material used for forming the engaging parts 54. Thus, this construction ensures that the engaging surfaces 55A stably receive the drive force, while suppressing an increase in production costs for the developing cartridge 1.

7. Variations of the Embodiment

The left walls 58 of the engaging parts 54 in the embodiment described above may be configured to close the left ends of the respective engaging parts 54 completely or only partially. When the left walls 58 close the left ends of the engaging parts 54 partially, the left walls 58 close enough of the left ends of the engaging parts 54 to prevent the engaging protrusions 62A of the apparatus-side coupling 61 from getting caught in the internal spaces 59 of the engaging parts 54. More specifically, it is preferable that the left walls 58 should close at least half of the internal spaces 59 when viewed along the left-right direction.

While the invention has been described in detail with reference to the embodiments thereof, it would be apparent to those skilled in the art that various changes and modifications may be made therein without departing from the spirit of the invention.

What is claimed is:

1. A developing cartridge comprising:

an enclosure configured to accommodate developer therein and having a support part;

a developing roller; and a drive-force receiving member configured to receive a drive force from outside of the developing cartridge and supported by the support part so as to be rotatable about a rotational axis relative to the support part, the drive-force receiving member including:

a first cylindrical part having a gear part configured to transmit a drive force to the developing roller;

a second cylindrical part disposed radially inward of the first cylindrical part with a gap being formed between the first cylindrical part and the second cylindrical part, the second cylindrical part being in contact with the support part; and a receiving part configured to receive a drive force from outside of the developing cartridge, the receiving part being disposed outward of both of the first cylindrical part and the second cylindrical part in an axial direction in which the rotational axis extends, the receiving part having an internal space that is in communication with the gap formed between the first cylindrical part and the second cylindrical part, the receiving part being disposed such that the receiving part overlaps the gap between the first cylindrical part and the second cylindrical part when the receiving part is viewed in the axial direction, and the receiving part having an outward end in the axial direction, at least part of the outward end of the receiving part being closed.

2. The developing cartridge according to claim 1, wherein a radial direction is defined orthogonal to the rotational axis, wherein the receiving part has an outer radial end that is farthest from the rotational axis in the radial direction, and wherein the outer radial end of the receiving part is positioned closer to the rotational axis in the radial direction than the gear part is, and is positioned farther away from the rotational axis in the radial direction than the second cylindrical part is.

3. The developing cartridge according to claim 1, wherein the drive-force receiving member overlaps the developing roller when the drive-force receiving member is seen in the axial direction.

4. The developing cartridge according to claim 1, wherein a radial direction is defined orthogonal to the rotational axis, wherein the receiving part has an inner radial end that is closest to the rotational axis in the radial direction, and wherein an outer circumferential surface of the support part is positioned further away from the rotational axis in the radial direction than the inner radial end of the receiving part is.

5. The developing cartridge according to claim 1, wherein a radial direction is defined orthogonal to the rotational axis, wherein the drive-force receiving member includes:

a base part disposed outward of both of the first cylindrical part and the second cylindrical part in the axial direction and aligned with the radial direction; and a third cylindrical part extending from the base part outwardly in the axial direction such that the receiving part is disposed radially inward of the third cylindrical part, wherein the receiving part is connected to both of the base part and the third cylindrical part, wherein the receiving part includes:

a first wall extending from the third cylindrical part inward in an orthogonal direction, the orthogonal direction being orthogonal to the axial direction and not passing through the rotational axis, the first wall having an inner end in the orthogonal direction;

a second wall extending from the inner end of the first wall in a rotating direction in which the drive-force receiving member is configured to rotate, the second wall having a downstream end in the rotating direction;

a third wall extending from the downstream end of the second wall outward substantially in the radial direction and being connected to the third cylindrical part; and a fourth wall aligned with the radial direction and disposed apart from the base part in the axial direction, the fourth wall being connected to: the first wall; the second wall; the third wall; and the third cylindrical part.

6. The developing cartridge according to claim 1, wherein a radial direction is defined orthogonal to the rotational axis, wherein the receiving part includes a receiving surface configured to receive a drive force from a drive source disposed outside of the developing cartridge, wherein the receiving surface includes a first radial end farthest from the rotational axis in the radial direction and a second radial end closest to the rotational axis in the radial direction, wherein a first distance is defined as a distance between the first radial end and the second radial end of the receiving surface in a direction orthogonal to the axial direction, and a second distance is defined as a distance between the rotational axis and the first radial end of the receiving surface in the radial direction, and wherein the first distance is smaller than or equal to ½ of the second distance.

7. The developing cartridge according to claim 6, wherein the first distance is smaller than or equal to $\frac{1}{2.8}$ of the second distance.

8. The developing cartridge according to claim 6, wherein the first distance is greater than or equal to ⅛ of the second distance.

9. The developing cartridge according to claim 1, wherein a radial direction is defined orthogonal to the rotational axis, wherein the receiving part includes a receiving surface configured to receive a drive force from a drive source disposed outside of the developing cartridge, wherein the receiving surface includes a first radial end farthest from the rotational axis in the radial direction and a second radial end closest to the rotational axis in the radial direction, wherein a first distance is defined as a distance between the first radial end and the second radial end of the receiving surface in a direction orthogonal to the axial direction, and wherein the first distance is greater than or equal to 2.8 mm and is smaller than or equal to 2.95 mm.

10. A developing cartridge comprising:

an enclosure configured to accommodate developer therein;

a developing roller; and a drive-force receiving member including a receiving part and a gear part, the receiving part having a receiving surface configured to receive a drive force from a drive source disposed outside of the developing cartridge, the gear part being configured to transmit a drive force to the developing roller, the drive-force receiving member being configured to rotate about a rotational axis, a radial direction being defined orthogonal to the rotational axis, the receiving surface including a first radial end farthest from the rotational axis in the radial direction and a second radial end closest to the rotational axis in the radial direction, and a first distance being defined as a distance between the first radial end and the second radial end of the receiving surface in a direction orthogonal to an axial direction, a second distance being defined as a distance between the rotational axis and the first radial end of the receiving surface in the radial direction, and the first distance being smaller than or equal to $\frac{1}{2.8}$ of the second distance.

11. The developing cartridge according to claim 10, wherein the first distance is greater than or equal to ⅛ of the second distance.

12. The developing cartridge according to claim 10, wherein the first distance is greater than or equal to 2.8 mm and is smaller than or equal to 2.95 mm.

13. A developing cartridge comprising:

an enclosure configured to accommodate developer therein;

a developing roller; and a drive-force receiving member including a receiving part and a gear part, the receiving part having a receiving surface configured to receive a drive force from a drive source disposed outside of the developing cartridge, the gear part being configured to transmit a drive force to the developing roller, the drive-force receiving member being configured to rotate about a rotational axis, a radial direction being defined orthogonal to the rotational axis, the receiving surface including a first radial end farthest from the rotational axis in the radial direction and a second radial end closest to the rotational axis in the radial direction, and a first distance being defined as a distance between the first radial end and the second radial end of the receiving surface in a direction orthogonal to an axial direction, a second distance being defined as a distance between the rotational axis and the first radial end of the receiving surface in the radial direction, and the first distance being smaller than or equal to ½ of the second distance and the first distance being greater than or equal to 2.8 mm and being smaller than or equal to 2.95 mm.

* * * * *